US010932968B2

(12) United States Patent
Hosokawa et al.

(10) Patent No.: US 10,932,968 B2
(45) Date of Patent: Mar. 2, 2021

(54) CONTROL DEVICE AND ELECTRIC FURNITURE

(71) Applicant: PARAMOUNT BED CO., LTD., Tokyo (JP)

(72) Inventors: Yuji Hosokawa, Tokyo (JP); Masato Shimokawa, Tokyo (JP); Tomoki Yoshida, Tokyo (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 0 days.

(21) Appl. No.: 16/481,808

(22) PCT Filed: Apr. 11, 2018

(86) PCT No.: PCT/JP2018/015254
§ 371 (c)(1),
(2) Date: Jul. 29, 2019

(87) PCT Pub. No.: WO2018/216387
PCT Pub. Date: Nov. 29, 2018

(65) Prior Publication Data

US 2020/0060908 A1 Feb. 27, 2020

(30) Foreign Application Priority Data

May 26, 2017 (JP) ..... JP2017-104153

(51) Int. Cl.
*A61G 7/018* (2006.01)
*A47C 20/08* (2006.01)
*A61G 7/05* (2006.01)

(52) U.S. Cl.
CPC ..... *A61G 7/018* (2013.01); *A47C 20/08* (2013.01); *A61G 7/05* (2013.01); *A61G 2203/34* (2013.01);
(Continued)

(58) Field of Classification Search
CPC ..... A61G 7/018; A61G 7/05; A61G 2203/34; A61G 2203/40; A61G 2203/46;
(Continued)

(56) References Cited

U.S. PATENT DOCUMENTS

2005/0062637 A1* 3/2005 El Zabadani ..... G06F 15/16 341/176
2007/0054651 A1* 3/2007 Farmer ..... H04W 52/0274 455/352
(Continued)

FOREIGN PATENT DOCUMENTS

CN 102224477 A 10/2011
JP H11175643 A 7/1999
(Continued)

OTHER PUBLICATIONS

International Search Report dated Jul. 18, 2018, mailed in counterpart International Application No. PCT/JP2018/015254, 12 pages.
(Continued)

*Primary Examiner* — Edwin C Holloway, III
(74) *Attorney, Agent, or Firm* — Kim & Stewart LLP

(57) ABSTRACT

According to an embodiment, a control device includes an operation part including an operation acceptor capable of accepting a control operation of a movable part of electric furniture, and includes a detector provided in the operation part. A non-accepting state in which the movable part is not controlled even when the operation acceptor receives an input transitions, based on a detection result of the detector, to an accepting state in which the movable part is controlled according to the control operation accepted by the operation acceptor. A control device and electric furniture are provided in which the operationability can be improved.

11 Claims, 13 Drawing Sheets

(52) U.S. Cl.
CPC ..... *A61G 2203/40* (2013.01); *A61G 2203/46* (2013.01)

(58) Field of Classification Search
CPC ..... A61G 2203/36; A61G 2203/44; A61G 2203/10; A61G 2203/12; A61G 2203/14; A61G 2203/16; A61G 2203/18; A61G 2203/20; A61G 2203/22; A47C 20/08
USPC ..... 340/4.11, 12.22, 12.54, 12.55; 341/176
See application file for complete search history.

(56) References Cited

U.S. PATENT DOCUMENTS

2010/0127914 A1* 5/2010 Maier ..... G08C 23/04 341/176
2010/0328201 A1* 12/2010 Marvit ..... G06F 3/017 345/156
2011/0140868 A1* 6/2011 Hovang ..... G08B 25/008 340/12.55
2011/0221623 A1* 9/2011 Yano ..... G08C 17/02 341/176
2014/0310876 A1 10/2014 Roussy et al.

FOREIGN PATENT DOCUMENTS

| | | | |
|---|---|---|---|
| JP | H11253495 | A | 9/1999 |
| JP | 2011125552 | A | 6/2011 |
| JP | 2011172885 | A | 9/2011 |
| JP | 2012029797 | A | 2/2012 |
| JP | 5483579 | B2 | 5/2014 |
| JP | 2012058241 | A | 3/2015 |
| JP | 2016038504 | A | 3/2016 |
| JP | 2016103237 | A | 6/2016 |

OTHER PUBLICATIONS

Japanese Office Action dated Oct. 7, 2020, mailed in counterpart Japanese Application No. 2017-104153, 10 pages (with translation).
Chinese Office Action dated Oct. 19, 2020, mailed in counterpart Chinese Application No. 201880015756.X, 22 pages (with translation).

* cited by examiner

CONTROL DEVICE AND ELECTRIC FURNITURE

TECHNICAL FIELD

An embodiment of the invention relates to a control device and electric furniture.

BACKGROUND ART

For example, there are electric furniture (e.g., an electric bed, an electric reclining chair, etc.) in which the angle of the backrest and/or the height are modifiable. These electric furniture are operated by a control device (e.g., a remote controller: remote control) such as a handy switch, etc. It is desirable to improve the operationability of such a control device.

PRIOR ART DOCUMENTS

Patent Literature

[Patent Literature 1]
Japanese Patent No. 5483579

SUMMARY OF INVENTION

Problem to be Solved by the Invention

An embodiment of the invention provides a control device and electric furniture in which the operationability can be improved.

Means for Solving the Problem

According to an embodiment, a control device includes an operation part including an operation acceptor capable of accepting a control operation of a movable part of electric furniture, and includes a detector provided in the operation part. Based on a detection result of the detector, a non-accepting state in which the movable part is not controlled even when the operation acceptor receives an input transitions to an accepting state in which the movable part is controlled according to the control operation accepted by the operation acceptor.

According to another embodiment, the electric furniture includes a movable part and a controller. The controller includes an operation part including an operation acceptor capable of accepting a control operation of the movable part, and includes a detector provided in the operation part. A non-accepting state in which the movable part is not controlled even when the operation acceptor receives an input transitions, based on a detection result of the detector, to an accepting state in which the movable part is controlled according to the control operation accepted by the operation acceptor.

Effects of the Invention

An embodiment of the invention can provide a control device and electric furniture in which the operationability can be improved.

MODES FOR CARRYING GUT THE INVENTION

Figure 1A:
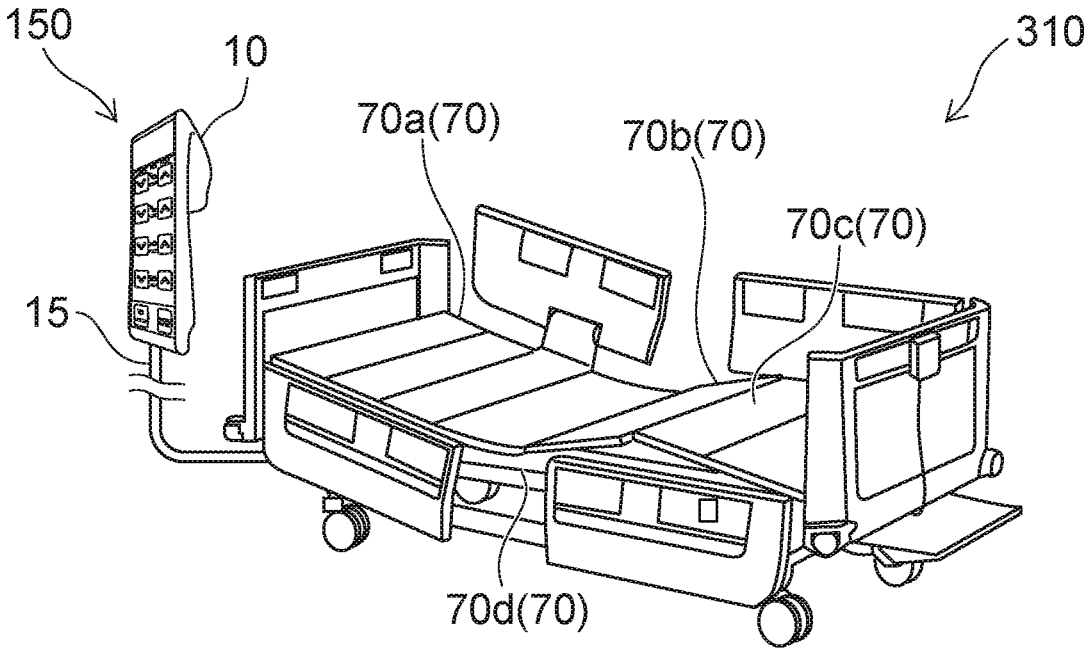
FIG. 1A and FIG. 1B are schematic perspective views illustrating a control device and electric furniture according to a first embodiment.

Various embodiments are described below with reference to the accompanying drawings.

The drawings are schematic and conceptual; and the relationships between the thickness and width of portions, the proportions of sizes among portions, etc., are not necessarily the same as the actual values. The dimensions and proportions may be illustrated differently among drawings, even for identical portions.

In the specification and drawings, components similar to those described previously or illustrated in an antecedent drawing are marked with the same reference numerals; and a detailed description is omitted as appropriate.

First Embodiment

Figure 1B:
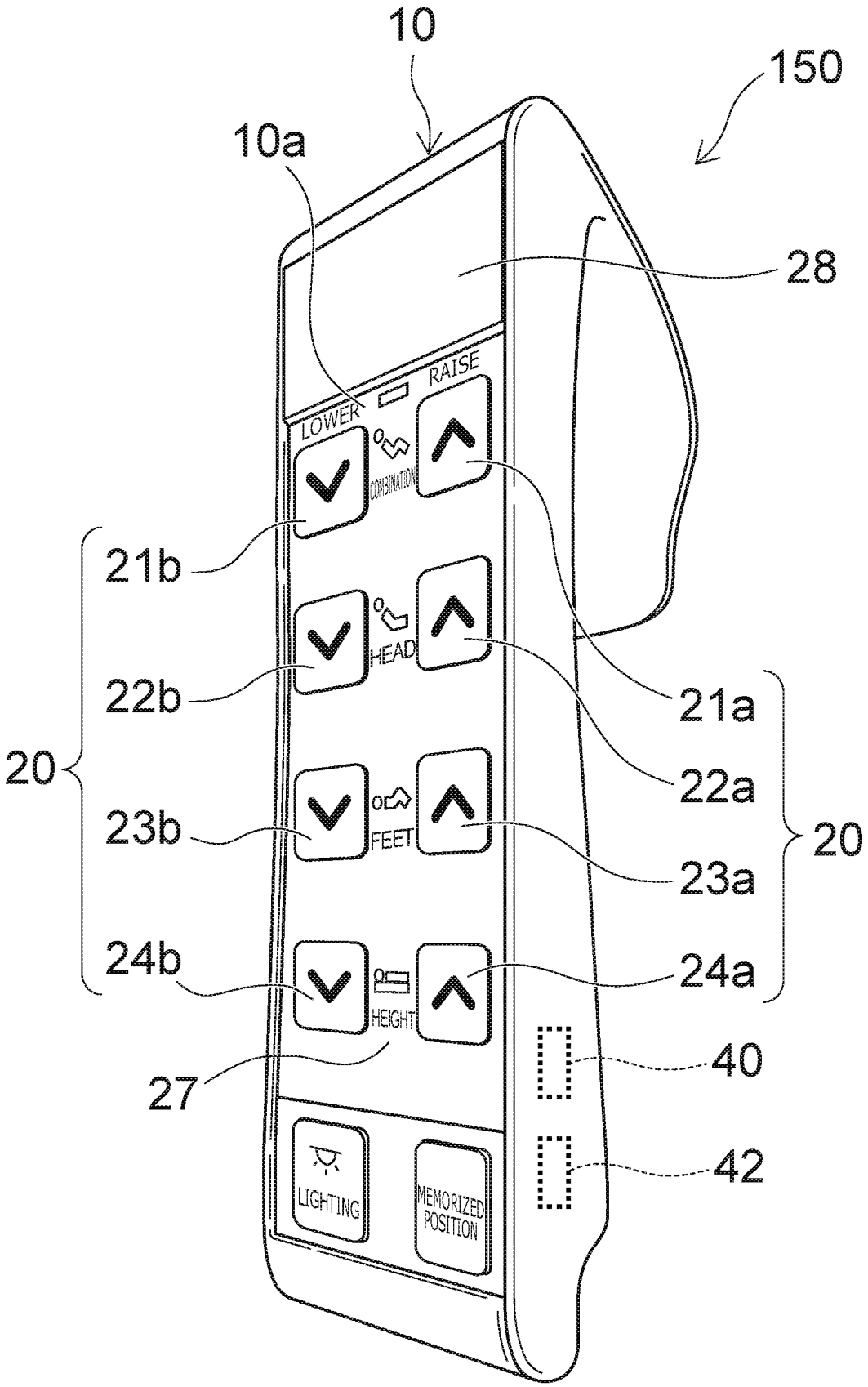

FIG. 1A and FIG. 1B are schematic perspective views illustrating a control device and electric furniture according to a first embodiment.

As shown in FIG. 1A, the control device 150 according to the first embodiment is used with the electric furniture 310. The control device 150 can control a movable part 70 of the electric furniture 310. The control device 150 is, for example, a remote controller (a remote control) of the electric furniture 310. The control device 150 is, for example, a handy switch. The control device 150 may include various functions such as an ON/OFF function of lighting, a paging function of a nurse or a caregiver, an ON/OFF function of a power supply, etc.

For example, the electric furniture 310 is used in a hospital, a care facility, a household, etc.

In the example, the electric furniture 310 is an electric bed. The electric bed includes the movable part 70. The movable part 70 includes, for example, a back section 70*a*, an upper leg section 70*b*, a lower leg section 70*c*, a height adjuster 70*d*, etc. The angles between the back section 70*a*, the upper leg section 70*b*, and the lower leg section 70*c* are modifiable. The angle of the upper body of the body is modifiable by the operation of the back section 70*a*. For example, the angle of the back is modifiable by modifying the angle between the back section 70*a* and the upper leg section 70*b*. The angle of the knees is modifiable by modifying the angle between the upper leg section 70*b* and the lower leg section 70*c*. These angles may be changed in combination. For example, the height adjuster 70*d* can modify the distance (the height) between the floor surface and the bed surface. These movable parts 70 include, for example, actuators, etc. By the operations of the movable parts 70, at least one of "back-raising," "knee-raising," "height adjustment," or the like is possible.

For example, the control device 150 is electrically connected to the movable part 70 recited above. A control circuit may be provided between the control device 150 and the movable part 70. Thus, the case where another circuit is provided therebetween also is included in the state of being electrically connected.

For example, the control device 150 is connected to the electric furniture 310 by a cable 15. The control device 150 may be connected to the electric furniture 310 by wireless communication.

As shown in FIG. 13, the control device 150 includes an operation part 10. The operation part 10 has a first surface 10*a*. The first surface 10*a* is, for example, an operation surface.

The operation part 10 includes an operation acceptor 20. The operation acceptor 20 is provided at the first surface 10*a*. The operation acceptor 20 can accept a control operation of the movable part 70 of the electric furniture 310. For example, the control operation is performed by the operator (the user) of the control device 150.

For example, multiple operation buttons are used as the operation acceptor 20. For example, when a raise button 22*a* relating to "head" is pressed, the angle of the back section 70*a* increases. For example, when a lower button 22*b* relating to "head" is pressed, the angle of the back section 70*a* decreases. For example, when a raise button 23*a* relating to "feet" is pressed, the angles of the upper leg section 70*b* and the lower leg section 70*c* increase. For example, when a lower button 23*b* relating to "feet" is pressed, the angles of the upper leg section 70*b* and the lower leg section 70*c* decrease. These angles are, for example, angles from the horizontal plane. For example, when a raise button 24*a* relating to "height" is pressed, the bed surface becomes higher. For example, when a lower button 24*b* relating to "height" is pressed, the bed surface becomes lower. For example, when a raise button 21*a* relating to "combination" is pressed, the "head" and the "feet" change in combination. For example, when a lower button 21*b* relating to "combination" is pressed, the "head" and the "feet" change in combination. These changes are performed by the operation of the movable part 70. For example, the operations recited above are performed in the period in which the operation buttons continue to be pressed. A safe operation is obtained thereby. A function displayer 27 that shows the functions of the operation buttons may be provided in the region between the multiple operation buttons.

Other than switches including mechanical contact points, the operation acceptor 20 may include any input device (e.g., touch switches, etc.) of an electrostatic type, an optical type, etc.

As shown in FIG. 1B, a display region 28 (e.g., a displayer) may be provided at the first surface 10*a*. For example, the display region 28 can display information (the angles of the sections, the height, etc.) relating to the movable part 70 of the electric furniture 310. Information that relates to the function or operating states of the operation acceptor 20 may be displayed in the display region 28.

As shown in FIG. 1B, a detector 40 is provided in the operation part 10. The detector 40 is fixed to the operation part 10. For example, the detector 40 is provided inside the operation part 10 (e.g., a housing). The detector 40 includes, for example, at least one of an acceleration sensor, a touch sensor, a temperature sensor, an illuminance sensor, a pulse wave sensor, an atmospheric pressure sensor, a vibration sensor, a pressure sensor, an image sensor, or a distance sensor. For example, in the case where the detector 40 includes an acceleration sensor, an acceleration (e.g., a vibration, etc.) applied to the detector 40 is detected by the detector 40. Thereby, it can be estimated whether or not the operation part 10 is held by the operator. Various examples of the detection by the detector 40 are described below.

The control device 150 includes a non-accepting state in which a control operation is not accepted, and an accepting state in which a control operation is accepted. These two states are switched based on the detection result of the detector 40.

For example, the control device 150 is in the non-accepting state in the state in which the control device 150 (the operation part 10) is suspended from the frame of the bed (the electric furniture 310) or in the state in which the control device 150 (the operation part 10) is placed on the bed, etc.

In the non-accepting state, for example, the movable part 70 is not controlled even when the operation acceptor 20 receives an input (e.g., a control operation, etc.). For example, the movable part 70 (e.g., the back section 70*a*) does not move even when an operation button (e.g., the raise button 22*a* relating to "head") is pressed.

For example, there are cases where an operation button (the operation acceptor 20) is pressed without the intention of the operator (the user) of the control device 150. It is dangerous for the movable part 70 to move due to the unintended input. At this time, because the control device 150 includes the non-accepting state recited above, a safe operation is obtained because the movable part 70 does not move in the case of the unintended input.

Based on the detection result of the detector 40, the control device 150 transitions from such a non-accepting state to the accepting state. For example, when an operation is performed such as the operator (the user) holding the control device 150 (the operation part 10) in a hand, etc., the operation is detected by the detector 40. Based on the detection result of the detector 40, the control device 150 transitions from the non-accepting state to the accepting state.

For example, in the case where the detector 40 includes an acceleration sensor, the acceleration that is applied to the detector 40 is detected by the detector 40. Thereby, it is estimated that the operation part 10 is held by the operator. At this time, the control device 150 transitions to the accepting state.

In the accepting state, the movable part 70 is controlled according to the control operations accepted by the operation acceptor 20. For example, when the raise button 22*a* relating to "head" is pressed in the accepting state, the angle of the back section 70*a* increases. The desired control operation can be performed. Thus, when the detector 40 detects that the control device 150 is being held, the control device 150 transitions from the non-accepting state to the accepting state. Then, in the accepting state, the movable part 70 is controlled according to the control operations accepted by the operation acceptor 20. For example, in the case where the electric furniture 310 is a bed and the movable part 70 includes the section 70 of the bed, at least one operation of raising/lowering or back-raising is performed in the accepting state.

Thus, in the embodiment, the control device 150 transitions from the non-accepting state to the accepting state based on the detection result of the detector 40. The transition is performed based on the detection result of the detector 40. Accordingly, it is unnecessary for the operator (the user) to perform an operation to transition from the non-accepting state to the accepting state. It is sufficient for the operator only to operate the operation acceptor 20 transitioned to the accepting state. The operation of the operator is one operation (i.e., one action, i.e., a "single action").

On the other hand, for example, there is a first reference example in which a switch (e.g., a power supply switch, etc.) for transitioning from the non-accepting state to the accepting state is provided. In the first reference example, first, the operator operates the switch to transition from the non-accepting state to the accepting state; subsequently, the operator operates the operation acceptor 20. Two actions are necessary; and the operation is complex. In the case where the operator is a senior citizen, etc., the operation of the switch may be forgotten undesirably; and the operation cannot be performed.

For example, there is a second reference example in which the non-accepting state transitions to the accepting state due to an operation button (the operation acceptor 20) being pressed once. The desired control operation is performed by further pressing the operation button after transitioning to the accepting state. The second reference example has a "double action;" and the operation is complex. In the case where the operator is a senior citizen, etc., it may be forgotten that an operation is performed once to switch to the accepting state and then the desired operation is performed. There are also cases where the operation cannot be performed.

On the other hand, a third reference example may be considered in which the non-accepting state is not provided. In such a case, the control device is in the accepting state constantly. In such a case, as described above, there are cases where the movable part 70 is moved by an unintended input.

Conversely, in the embodiment, the operation acceptor 20 transitions from the non-accepting state to the accepting state based on the detection result of the detector 40. Thereby, it is unnecessary for the operator (the user) to operate the transition from the non-accepting state to the accepting state. A "single-action" operation is possible. A control device and electric furniture can be provided in which the operationability can be improved. Good safety also is obtained.

On the other hand, there is a method (a fourth reference example) for a portable information device such as a mobile telephone, a smartphone, a tablet computer, etc., in which the operation of the information device is controlled by estimating whether or not the information device is being held by the user. For example, when the information device is being held by the user, the vibration (the acceleration) of the information device is larger than the vibration (e.g., the acceleration) when the information device is placed on a desk. By detecting the vibration, the power supply of the information device is turned off (a sleep state) when it is estimated that the information device is not being held by the user. In such an example, the vibration or the like received by the information device itself operated by the user is detected; and the information device is controlled based on the detection. Such a control is directed to reduce the power consumption. In an information device such as that recited above, an unsafe state of the user rarely occurs even when a misoperation or a misrecognition of the input exists.

Conversely, in the embodiment, the state of the control device 150 (the operation part 10: remote controller) used with the electric furniture 310 is detected by the detector 40. For example, in the case where the approach of the fourth reference example recited above is applied, the operation/non-operation of the electric furniture 310 would be controlled by detecting the state (e.g., the vibration, the acceleration, etc.) of the electric furniture 310. For example, the electric furniture 310 would be set to the sleep state when the electric furniture 310 undergoes an acceleration.

Conversely, in the embodiment, unlike such an approach, the state of the control device 150 (the operation part 10) used with the electric furniture 310 is detected by the detector 40; and the switching between the non-accepting state and the accepting state of the control device 150 is performed. Thus, the state is switched by detecting the state of the control device 150 used with the electric furniture 310 by the detector 40 because this is a special circumstance in which a safe operation is required for the electric furniture 310 which is the control object of the control device 150.

On the other hand, for a remote controller (a control device) operating a crane, etc., the operator is an expert. Conversely, the operator (the user) of the electric furniture 310 is a non-expert also including, for example, a senior citizen, etc. Therefore, there are special circumstances in which it is difficult to apply a complex operation.

Thus, a special circumstance exists for the control device 150 used with the electric furniture 310. Based on such a circumstance, in the embodiment, the detector 40 is provided in the operation part 10 of the control device 150 used with the electric furniture 310. Then, the transition from the non-accepting state to the accepting state is performed based on the detection result of the detector 40. Thereby, the electric furniture 310 can be controlled to the desired state by a "single-action" simple operation while maintaining good safety. An easy operation can be possible even by a non-expert such as a senior citizen, etc.

In the embodiment, for example, the non-accepting state and the accepting state are controlled by a controller 42 (referring to FIG. 1B). The controller 42 may be provided in the control device 150 (the operation part 10). The controller 42 may be provided in the electric furniture 310. The controller 42 may be provided separately from the control device 150 and the electric furniture 310. Any wired or wireless configuration is applicable to the transmission/reception of the information (the signals) between the controller 42 and the control device 150 and the transmission/reception of the information (the signals) between the controller 42 and the electric furniture 310.

An example of the control of switching between the non-accepting state and the accepting state recited above will now be described.

Figure 2:
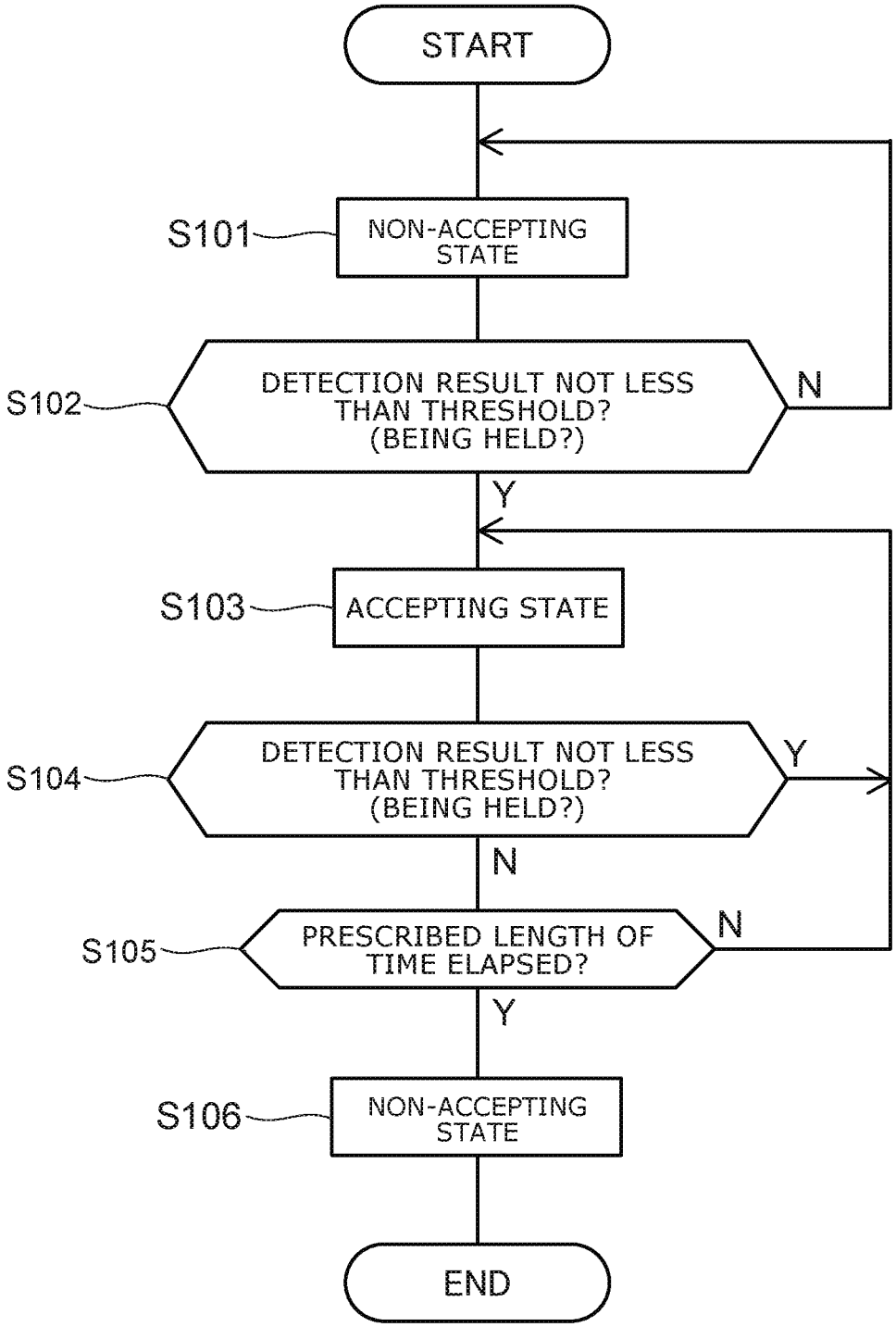
FIG. 2 is a flowchart illustrating the operation of the control device according to the first embodiment.

FIG. 2 is a flowchart illustrating the operation of the control device according to the first embodiment.

For example, the control device 150 (the operation part 10) is suspended from the frame of an electric bed (the electric furniture 310), etc. In this state, the control device 150 is in the non-accepting state (step S101).

It is determined whether or not the detection result of the detector 40 is not less than a threshold (step S102). When the state in which the detection result is not less than the threshold continues for not less than a threshold time, for example, it is estimated that the operation part 10 is being held. On the other hand, when the detection result is less than the threshold, for example, it is estimated that the operation part 10 is not being held. When the detection result is less than the threshold, the flow returns to step S101; and the non-accepting state is maintained. In the non-accepting state, the movable part 70 is not controlled even when the operation acceptor 20 receives an input. For example, the undesirable unintentional operation of the movable part 70 can be suppressed in the case where the control device 150 is placed in the state in which the operation acceptor 20 is downward, etc. Good safety is obtained.

When the detection result of the detector 40 is not less than the threshold (e.g., when it is estimated that the operation part 10 is being held), the control device 150 transitions to the accepting state (step S103). When the operation acceptor 20 is operated in the accepting state, the movable part 70 moves according to the operation. For example, the section angle, the height, etc., of the bed (the electric furniture 310) can be adjusted.

Further, it is determined whether or not the detection result of the detector 40 is not less than the threshold (step S104). When the detection result of the detector 40 is not less than the threshold (e.g., when it is estimated that the operation part 10 is being held), the flow returns to step S103; and the accepting state continues.

When the detection result of the detector 40 is less than the threshold (e.g., when it is estimated that the operation part 10 is not being held) in step S104, it is determined whether or not the period of no operations input to the operation acceptor 20 has reached a prescribed length of time (step S105). Thereby, for example, it is estimated whether or not the operation by the operator has ended. When the prescribed period of time has not elapsed, the flow returns to step S103. When the prescribed period of time has elapsed, the control device 150 is set to the non-accepting state (step S106). Then, the series of controls ends. Or, the flow may return to step S101.

By providing step S105 recited above, for example, the frequent switching between the non-accepting state and the accepting state, etc., can be suppressed.

For example, controller 42 performs at least one of the comparison between the detection result of the detector 40 and the threshold (the estimation of whether or not the operation part 10 is being held), the switching from the non-accepting state to the accepting state, the switching from the accepting state to the non-accepting state, or the determination of the passage of time.

In the accepting state as described above, the movable part 70 moves when the operation acceptor 20 accepts a control operation. On the other hand, when the operation acceptor 20 receives an input in the non-accepting state, the movable part 70 does not perform the operation corresponding to the input. The input that the operation acceptor 20 receives in the non-accepting state may not be an operation by the operator, and includes cases where any object contacts the operation acceptor 20, or any object approaches the operation acceptor 20. In the non-accepting state, the "movable part 70 not performing the operation corresponding to the input" includes the movable part 70 not moving.

The non-accepting state includes various states such as the following. In one example, when the operation acceptor 20 receives an input in the non-accepting state, the operation acceptor 20 does not output the input as a signal. For example, in the case where an operation button is used, even when the operation button is pressed, a signal that corresponds to the ON/OFF of the electrical contact is not output.

In another example, when the operation acceptor 20 receives an input and the signal output from the operation acceptor 20 is supplied toward the controller 42, the controller 42 does not accept the signal.

In another example, when the operation acceptor 20 receives an input and the signal output from the operation acceptor 20 is supplied to the controller 42, a control signal based on the signal is not output to the electric furniture 310 from the controller 42.

In another example, the movable part 70 of the electric furniture 310 may not be operated even when the control signal from the controller 42 is output to the electric furniture 310. In other words, the non-accepting state and the accepting state of the movable part 70 are controlled based on the state of the control device 150. Even in such a case, the non-accepting state may be considered as one state of the control device 150 because the movable part 70 is not operated according to the state of the control device 150 (the operation part 10). In other words, any state in which the movable part 70 is not controlled when any input is supplied to the operation acceptor 20 is taken as the "non-accepting state."

Several examples of configurations and operations of the control device will now be described. Although the controller 42 is provided in the operation part 10 in the following examples, the controller 42 may be provided separately from the operation part 10 (the control device) as described above.

Figure 3:
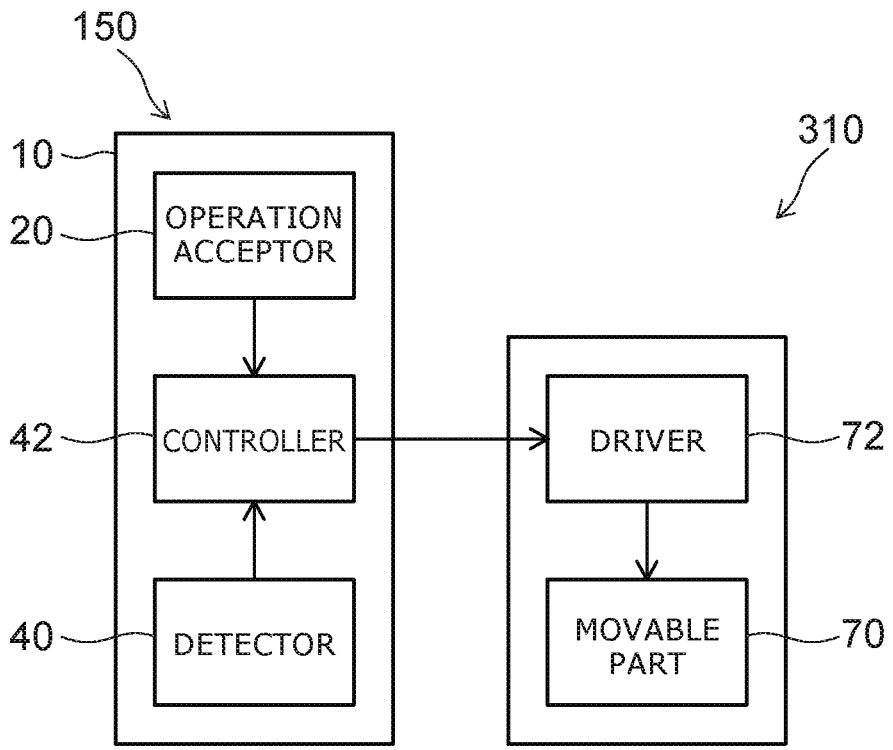
FIG. 3 is a block diagram illustrating the control device and the electric furniture according to the first embodiment.

FIG. 3 is a block diagram illustrating the control device and the electric furniture according to the first embodiment.

As shown in FIG. 3, the control device 150 includes the operation acceptor 20, the detector 40, and the controller 42.

For example, the detector 40 and the controller 42 are provided in a space of the interior of the operation part 10. The detector 40 and the controller 42 may be provided in any location of the operation part 10.

As described above, the detector 40 includes, for example, at least one of an acceleration sensor, a touch sensor, a temperature sensor, an illuminance sensor, a pulse wave sensor, an atmospheric pressure sensor, a vibration sensor, a pressure sensor, an image sensor, or a distance sensor.

For example, the acceleration sensor detects an acceleration applied to the operation part 10. By detecting the acceleration applied to the operation part 10, it can be estimated whether or not the operation part 10 is held by the operator. For example, the orientation of the operation part 10 can be detected by a three-axis acceleration sensor (a gyro sensor). The "orientation" includes, for example, the orientation of the first surface 10*a* (the surface where the operation acceptor 20 is provided) when referenced to gravity. For example, it can be estimated whether or not the operation part 10 is held by the operator by detecting the change of the orientation of the operation part 10.

For example, the touch sensor detects a change of an electrostatic capacitance, a change of a current, etc. For example, the contact (or the approach) of an object to the operation part 10 is detected. By using the touch sensor, it can be estimated whether or not the operation part 10 is held by the operator.

For example, the temperature sensor detects the temperature of the operation part 10 (or the periphery of the operation part 10, etc.). For example, it can be estimated whether or not the operation part 10 is held by the operator by detecting the change of the temperature of the outer surface of the operation part 10. For example, when the temperature of the outer surface of the operation part 10 raises, it can be estimated that the operation part 10 is held by the operator.

For example, the illuminance sensor detects the brightness of the periphery of the operation part 10. It can be estimated whether or not the operation part 10 is held by the operator by detecting the change of the brightness of the periphery of the operation part 10. For example, it can be estimated that the operation part 10 is held by the operator when the periphery of the operation part 10 becomes a dark state abruptly from a bright state.

For example, the pulse wave sensor detects a pulse wave. The pulse wave has a periodic pattern unique to a body. For example, the pulse wave of the body propagates to the operation part 10 when the operation part 10 is held by the operator. It can be estimated whether or not the operation part 10 is held by the operator by detecting the pulse wave.

For example, the atmospheric pressure sensor detects the atmosphere (atmospheric pressure) of the periphery of the operation part 10. For example, information that relates to the change of the position in the height direction of the operation part 10 can be obtained from the detection result of the atmospheric pressure sensor. For example, it can be estimated whether or not the operation part 10 is held by the operator by detecting the sudden change of the position in the height direction of the operation part 10.

For example, the vibration sensor detects the vibration of the operation part 10. It can be estimated whether or not the operation part 10 is held by the operator by detecting the vibration of the operation part 10.

For example, the pressure sensor detects the pressure applied to the operation part 10. For example, the pressure that is applied to the operation part 10 changes when the operation part 10 is held by the operator. It can be estimated whether or not the operation part 10 is held by the operator by detecting the pressure applied to the operation part 10.

For example, the image sensor images the periphery of the operation part 10. For example, the face or the hand of the operator approaching the operation part 10 can be detected by the image sensor. For example, the detection of the face or the hand is performed by image recognition. For example, it can be estimated whether or not the operation part 10 is held by the operator by detecting the face or the hand of the operator approaching the operation part 10.

For example, the distance sensor measures the distance to an object (e.g., the hand of the operator, etc.) using infrared, a radio wave, etc. It can be estimated whether or not the operation part 10 is held by the operator based on the output of the distance sensor. For example, it can be estimated that the operation part 10 is held by the operator when the distance from the operation part 10 to the object is not more than a threshold.

In the case where the acceleration sensor or the like is used as the detector 40, the state in which the operator holds the operation part 10 is detected. In the case where the image sensor, the distance sensor, or the like is used as the detector 40, the state is detected in which the hand, etc., of the operator approaches the operation part 10 and is about to hold the operation part 10. Any configuration that can estimate whether or not the operation part 10 is held by the operator or is about to be held by the operator is applicable to the detector 40.

For example, the controller 42 is connected to the operation acceptor 20 and the detector 40. For example, a signal based on a control operation accepted by the operation acceptor 20 (e.g., the buttons 21*a*, 21*b*, 22*a*, 22*b*, 23*a*, 23*b*, 24*a*, and 24*b*) is supplied to the controller 42. On the other hand, the detection result of the detector 40 is supplied to the controller 42.

For example, the controller 42 is electrically connected to the electric furniture 310 via the cable 15 (referring to FIG. 1A, etc.), etc. The controller 42 supplies, to the electric furniture 310, the control signal corresponding to the control operation accepted by the operation acceptor 20.

In addition to the movable part 70, a driver 72 is provided in the electric furniture 310. The driver 72 is connected to the movable part 70 and connected to the controller 42. The driver 72 drives the movable part 70 according to a control signal supplied from the controller 42. Thereby, in the accepting state, the movable part 70 moves according to the control operations accepted by the operation acceptor 20. For example, "back-raising," "knee-raising," "height adjustment," etc., are performed. On the other hand, the movable part 70 does not move in the non-accepting state.

For example, the detector 40 and the controller 42 may continue to operate even when the control device 150 is in the non-accepting state.

As described below, the accepting state may transition to the non-accepting state when the operation part 10 is placed with the operation acceptor 20 facing downward.

For example, in the case where the acceleration sensor is used as the detector 40, the state in which the operation part 10 is placed with the operation acceptor 20 facing downward can be detected by the acceleration sensor. The control device 150 may be set to the non-accepting state when the detector 40 detects that the operation acceptor 20 is placed facing downward.

Thereby, for example, in the case where the operation part 10 is placed on a bed, a table, etc., in the state in which the operation acceptor 20 is downward, the undesirable unintended operation of the movable part 70 due to the unintended input to the operation acceptor 20 by the bed, the table, etc., can be suppressed. For example, the unintended operation of the movable part 70 can be suppressed while suppressing an increase of the number of components, a higher cost, etc.

The detection by the detector 40 of the state in which the operation part 10 is placed may be performed by, for example, an illuminance sensor, etc. For example, illuminance sensors are provided on each of the operation surface and the back surface. It can be estimated that the operation part 10 is placed with the operation acceptor 20 facing downward in the case where the brightness of the operation surface becomes markedly dark compared to the brightness of the back surface. For example, it can be estimated that the operation part 10 is placed with the operation acceptor 20 facing downward in the case where a touch sensor is provided on the operation surface and contact with the operation surface is detected. Or, for example, touch sensors may be provided on each of the operation surface and the back surface. It can be estimated that the operation part 10 is placed with the operation acceptor 20 facing downward in the case where contact is detected only at the operation surface.

Second Embodiment

A notification operation is performed in a second embodiment. The switching between the non-accepting state and the accepting state described in the first embodiment may be performed in the second embodiment.

Figure 4:
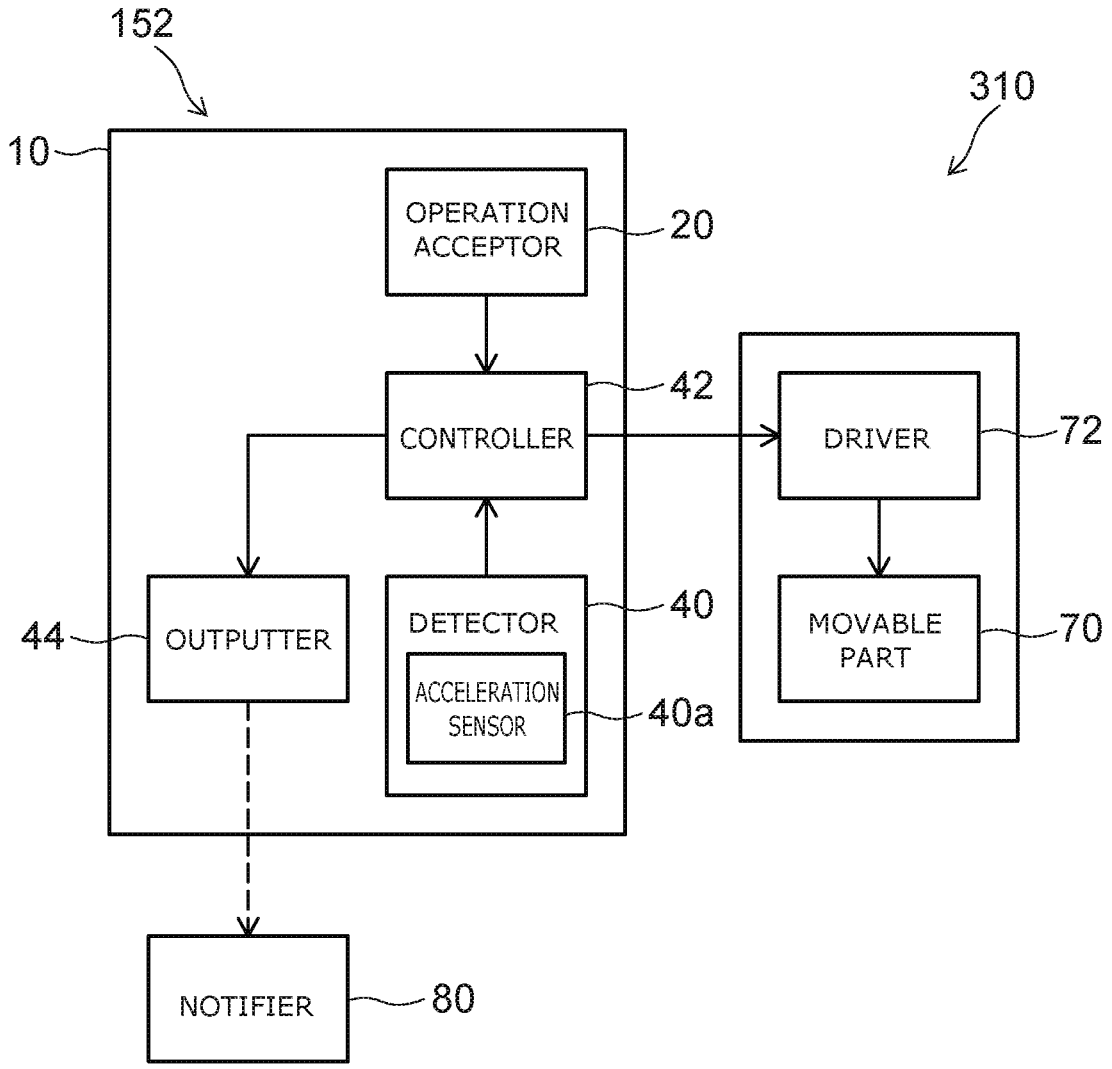
FIG. 4 is a block diagram illustrating a control device and electric furniture according to a second embodiment.

FIG. 4 is a block diagram illustrating a control device and electric furniture according to the second embodiment.

As shown in FIG. 4, the control device 152 further includes an outputter 44 in addition to the operation acceptor 20, the detector 40, and the controller 42. In the example, the detector 40 includes an acceleration sensor 40*a*. Otherwise, the configuration of the control device 152 can be similar to the configuration of the control device 150; and a description is therefore omitted.

For example, the outputter 44 is connected to the controller 42. For example, due to a control of the controller 42, the outputter 44 outputs a notification signal to an external notifier 80. The outputter 44 is, for example, a communication interface.

The notifier 80 performs a notification according to the signal supplied from the outputter 44. For example, the notifier 80 performs the notification to a caregiver, etc., by using an emission of light, an output of a voice, a display of a character, a drawing, etc. Any method such as wired, wireless, or the like is applicable to the communication between the outputter 44 and the notifier 80.

By using the acceleration sensor 40*a* as the detector 40, the detector 40 can detect a fall of the operation part 10. The detection result of the fall of the operation part 10 is supplied to the controller 42; and the controller 42 causes the output of the signal from the outputter 44. The notification is performed by the notifier 80.

For example, in the case where the electric furniture 310 is an electric bed installed in a hospital, the notifier 80 is a terminal provided in a nurse center, etc. For example, when a hospitalized patient, a care recipient, or the like drops the control device 152 to the floor, etc., there is a possibility that the hospitalized patient, the care recipient, or the like cannot pick up the control device 152 on one's own. In such a case, the fall of the operation part 10 is detected by the detector 40; and a notification to the terminal of the nurse center, etc., is performed according to the detection. Thereby, the fall of the operation part 10 (the control device 152) can be notified to a nurse, a physician, etc. A quick response is possible.

Because the detector 40 detects the fall of the operation part 10, the convenience can be improved while suppressing an increase of the number of components, a higher cost, etc. For example, the hospitalized patient, the care recipient, or the like no longer must pick up the fallen control device 152; and the safety can be improved further.

In the example recited above, the notification signal of the outputter 44 is supplied to an external device. In the embodiment, the outputter 44 may perform the notification. For example, the light, the voice, etc., may be output as the notification signal from the outputter 44. Any configuration that can notify a human of the periphery, etc., of the fall of the operation part 10 is applicable to the notification of the outputter 44.

Any sensor that can detect the fall of the operation part 10 such as, for example, a vibration sensor, an atmospheric pressure sensor, etc., can be used to detect the fall of the operation part 10 in the detector 40.

In the embodiment, the switching between the non-accepting state and the accepting state may be performed based on the detection result of the acceleration sensor 40*a*.

Third Embodiment

In a third embodiment, the function of the operation acceptor 20 is modifiable. In the third embodiment, the switching between the non-accepting state and the accepting state described in the first embodiment may be performed.

Figure 5A:
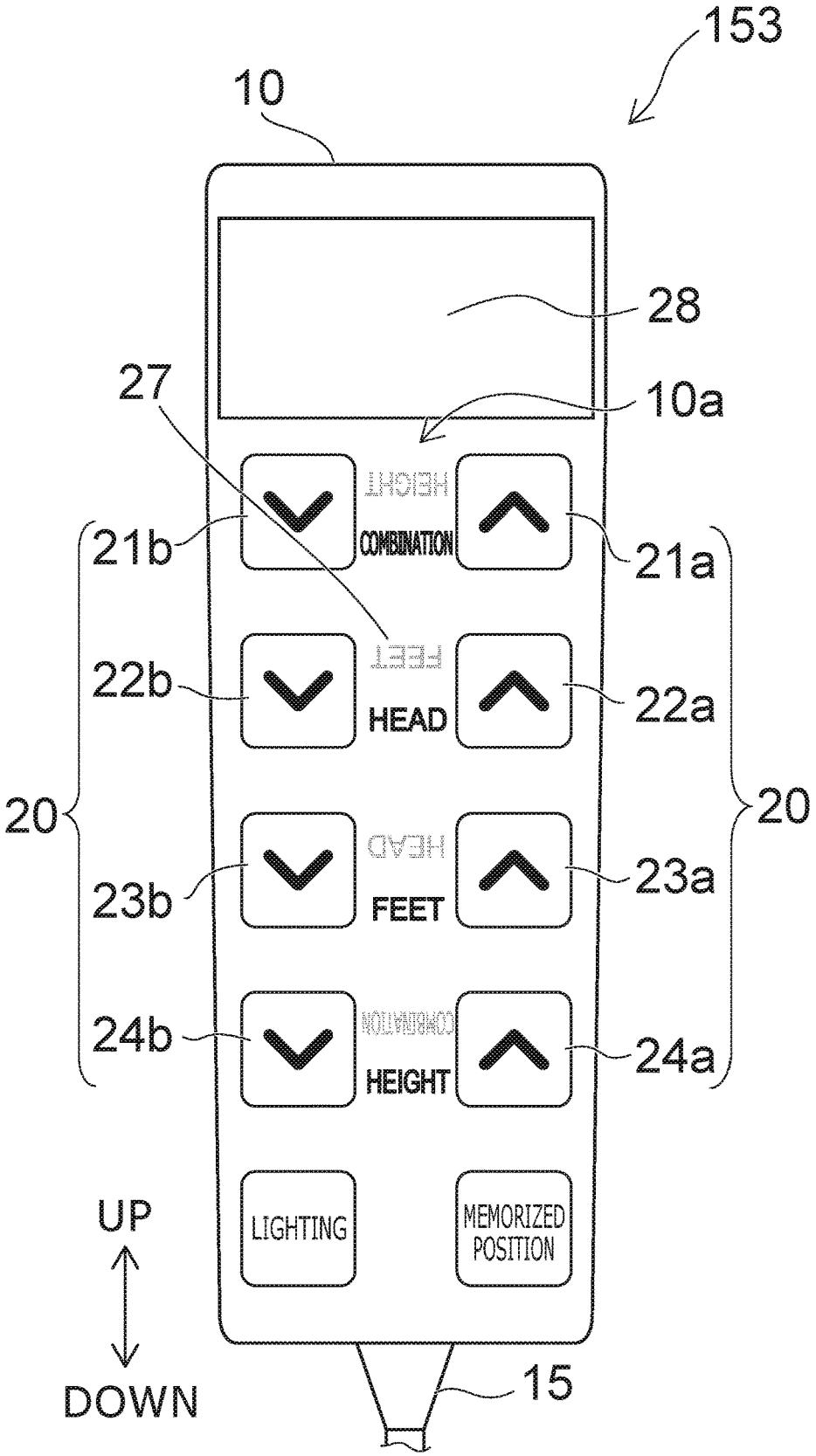
FIG. 5A and FIG. 5B are schematic views illustrating the operation of a control device according to a third embodiment.
Figure 5B:
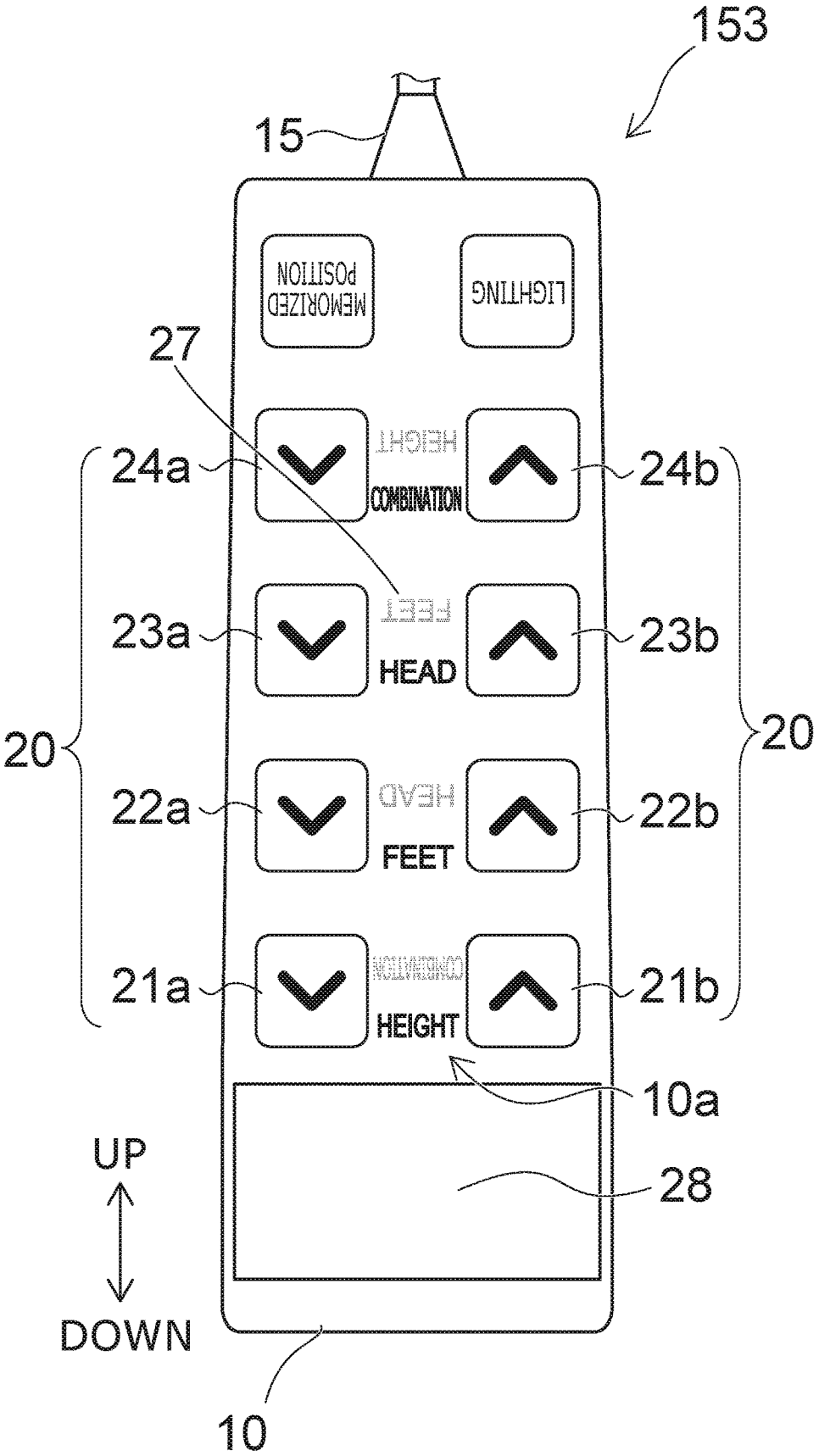

FIG. 5A and FIG. 5B are schematic views illustrating an operation of the control device according to the third embodiment.

FIG. 5A and FIG. 5B illustrate states of the control device 153 according to the third embodiment in which up and down (orientations when referenced to gravity) are mutually-reversed. The operation part 10, the operation acceptor 20, and the detector 40 (referring to FIG. 3) are provided in the control device 153 as well. In the embodiment, a modification of the function of the operation acceptor 20 of the control device 153 is performed. For example, the modification of the function is performed based on the orientation of the control device 153 referenced to gravity. The configuration of the control device 153 can be similar to the configuration of the control device 152; and a description is therefore omitted.

In the state (called "upward" for convenience) shown in FIG. 5A, the buttons 21*a*, 22*a*, 23*a*, and 24*a* have raising functions. Also, the buttons 21*b*, 22*b*, 23*b*, and 24*b* have lowering functions.

On the other hand, in the state (called "downward" for convenience) shown in FIG. 5B, the buttons 21*a*, 22*a*, 23*a*, and 24*a* have lowering functions. Also, the buttons 21*b*, 22*b*, 23*b*, and 24*b* have raising functions.

In other words, the function of one button is switched to raising or lowering according to the orientation of the control device 152. The detection of "upward" or "downward" recited above is performed by the detector 40.

For example, the orientation of the control device 152 referenced to gravity is detected by the acceleration sensor 40*a* (e.g., referring to FIG. 4), etc. The function of the operation acceptor 20 is modified based on the detection result. For example, the control of the modification of the function is performed by the controller 42.

For example, in the state ("upward") shown in FIG. 5A, the "head" is raised when the button 22*a* is pressed. Then, in the state ("downward") shown in FIG. 5B, the "head" is raised when the button 23*b* is pressed.

Thus, the function of the operation acceptor 20 is modifiable according to the detection result by the detector 40 of the orientation of the operation part 10. By modifying the function of the operation acceptor 20 according to the orientation of the operation part 10, for example, the operator can operate the operation acceptor 20 more sensibly. The operationability can be improved further.

In the example, the function displayer 27 is provided at the first surface 10*a* (the operation surface). The function displayer 27 can display the function of the operation acceptor 20. The function displayer 27 is provided at the vicinity of the operation acceptor 20 (e.g., the operation button).

In the state ("upward") shown in FIG. 5A, the characters "combination" are displayed in the function displayer 27 between the buttons 21*a* and 21*b*. The characters "head" are displayed in the function displayer 27 between the buttons 22*a* and 22*b*. The characters "feet" are displayed in the function displayer 27 between the buttons 23*a* and 23*b*. The characters "height" are displayed in the function displayer 27 between the buttons 24*a* and 24*b*.

On the other hand, in the state ("downward") shown in FIG. 5B, the characters "combination" are displayed in the function displayer 27 between the buttons 24*a* and 24*b*. The characters "head" are displayed in the function displayer 27 between the buttons 23*a* and 23*b*. The characters "feet" are displayed in the function displayer 27 between the buttons 24*a* and 24*b*. The characters "height" are displayed in the function displayer 27 between the buttons 21*a* and 21*b*.

In the example, "height" and "combination" are displayable by being switched in the function displayer 27 between the buttons 21*a* and 21*b*. Thus, in the function displayer 27, multiple functions are displayable by being switched.

In FIG. 5A, the characters "height" in the region between the buttons 21*a* and 21*b* are illustrated lighter than the characters "combination" to show that the characters "height" are not displayed, or the characters "height" are displayed to be darker than the characters "combination." The shading of the characters in the regions between the other two buttons are similar.

By providing such a function displayer 27, the operator can easily recognize the switching of the function linked to the change of the state between "upward" and "downward."

Further, the movement (e.g., the speed, etc.) of the movable part 70 corresponding to the control operation of the operation acceptor 20 may be changeable according to the detection result of the detector 40.

For example, in the case where a prescribed movement is applied to the operation part 10 in the state in which the button 22*a* is operated, the setting of the operation (e.g., the speed, etc.) of the back section 70*a* corresponding to the button 22*a* is modified. For example, in the case where a movement of tilting the operation part 10 upward is applied in the state in which the button 22*a* is operated, the raising rate of the back section 70*a* becomes faster. On the other hand, in the case where a movement of tilting the operation part 10 downward is applied in the state in which the button 22*a* is operated, the raising rate of the back section 70*a* becomes slower. For example, in the case where a prescribed movement is applied to the operation part 10 in the state in which the operation button (the operation acceptor 20) is not pressed, the setting of the speed (at least one of the raising rate or the lowering rate) of the movement of the movable part 70 may be modified. The modification of such an operation (e.g., the speed) may be performed by the controller 42.

By modifying the setting of the operation accompanying the operation of the operation acceptor 20 according to the movement of the operation part 10, for example, the user, etc., can operate the operation acceptor 20 more sensibly. The operationability is improved further.

In the embodiment, for example, the detection of at least one of the orientation or the movement of the operation part 10 by the detector 40 may be performed based on image data acquired by the image sensor. Any configuration is applicable to the detection of the at least one of the orientation or the movement.

In the embodiment, the switching between the non-accepting state and the accepting state may be performed based on the detection result of the detector 40.

Fourth Embodiment

In a fourth embodiment, the brightness (e.g., the luminous intensity, the luminance, etc.) of a light emitter provided in the operation part 10 is modified. The switching between the non-accepting state and the accepting state described in the first embodiment may be performed in the fourth embodiment.

Figure 6:
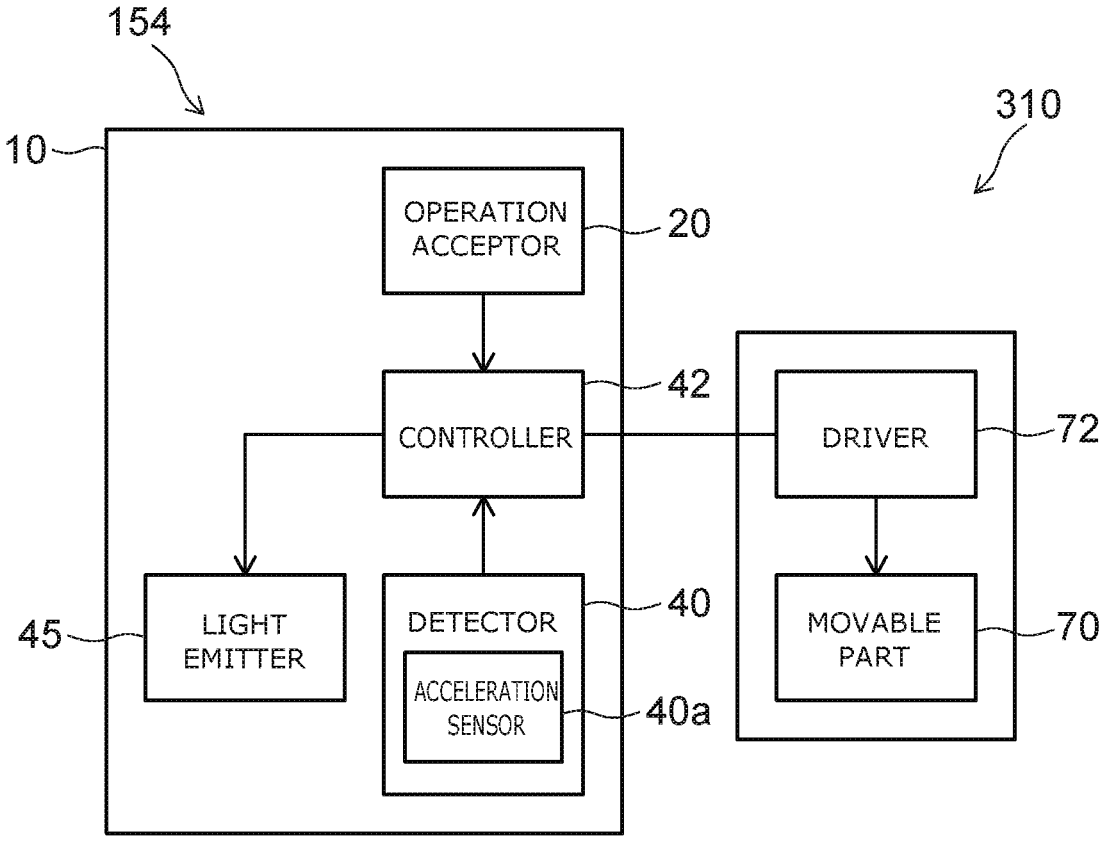
FIG. 6 is a block diagram illustrating a control device and electric furniture according to a fourth embodiment.

FIG. 6 is a block diagram illustrating the control device and the electric furniture according to the fourth embodiment.

As shown in FIG. 6, the control device 154 according to the embodiment includes a light emitter 45 in addition to the operation part 10, the operation acceptor 20, and the detector 40. Otherwise, the configuration of the control device 154 can be similar to the configuration of the control device 152; and a description is therefore omitted.

The light emitter 45 is provided in the operation part 10. The light emitter 45 emits light outside the operation part 10. For example, the light emitter 45 is connected to the controller 42. The brightness (e.g., the luminous intensity, the luminance, or the like) of the light emitter 45 is changeable according to the detection result by the detector 40 of the orientation of the operation part 10. For example, the on-state and the off-state of the light emitter 45 are switched. For example, the modification of the brightness is performed by the controller 42.

The light emitter 45 includes, for example, a light-emitting element such as an LED (Light Emitting Diode), etc. The light emitter 45 may include any element that can emit light. The light emitter 45 may be, for example, a light source of the display region 28, etc. The light emitter 45 may be, for example, a backlight of a liquid crystal display, etc.

The light emitter 45 emits light from the first surface 10*a* via a transmissive window, etc., in the case where the light emitter 45 is provided in the interior of the operation part 10. For example, the light emitter 45 may be provided in the operation acceptor 20 and may perform a display corresponding to the operation buttons. The light emitter 45 may be the function displayer 27 illustrated in FIG. 1B, FIG. 5A, and FIG. 5B.

For example, the detector 40 detects the orientation of the operation part 10. For example, the brightness of the light emitted from the light emitter 45 when the optical axis of the light emitted from the light emitter 45 is aligned with the horizontal direction is set to be lower than the brightness of the light emitted from the light emitter 45 when the optical axis of the light emitted from the light emitter 45 is not aligned with the horizontal direction. The angle between the optical axis and the horizontal direction in the state in which the optical axis is aligned with the horizontal direction is smaller than the angle between the optical axis and the vertical direction, The horizontal direction is a direction orthogonal to the direction of gravity. The vertical direction is parallel to the direction of gravity.

For example, there is a state in which the control device 154 is suspended from the frame of the electric furniture 310, etc. This state corresponds to the state in which the optical axis is aligned with the horizontal direction. In such a state, the light that is emitted from the light emitter 45 is easily incident on the eyes of the user sleeping on the electric furniture 310, etc. In particular, at night, etc., there is a possibility of glare being undesirably experienced by the user, etc.

In the embodiment, the orientation of the operation part 10 (the state in which the optical axis of the light emitted from the light emitter 45 is aligned with the horizontal direction) is detected by the detector 40. The brightness of the light emitted from the light emitter 45 is reduced according to the detection result. For example, the light emitter 45 is switched off. Thereby, the glare that is undesirably experienced by the user, etc., can be suppressed. The convenience can be improved further.

In the embodiment, the switching between the non-accepting state and the accepting state may be performed based on the detection result of the acceleration sensor 40*a*.

Fifth Embodiment

In a fifth embodiment, the brightness (e.g., the luminous intensity, the luminance, or the like) of the display region 28 provided in the operation part 10 is modified. The switching between the non-accepting state and the accepting state described in the first embodiment may be performed in the fifth embodiment.

Figure 7:
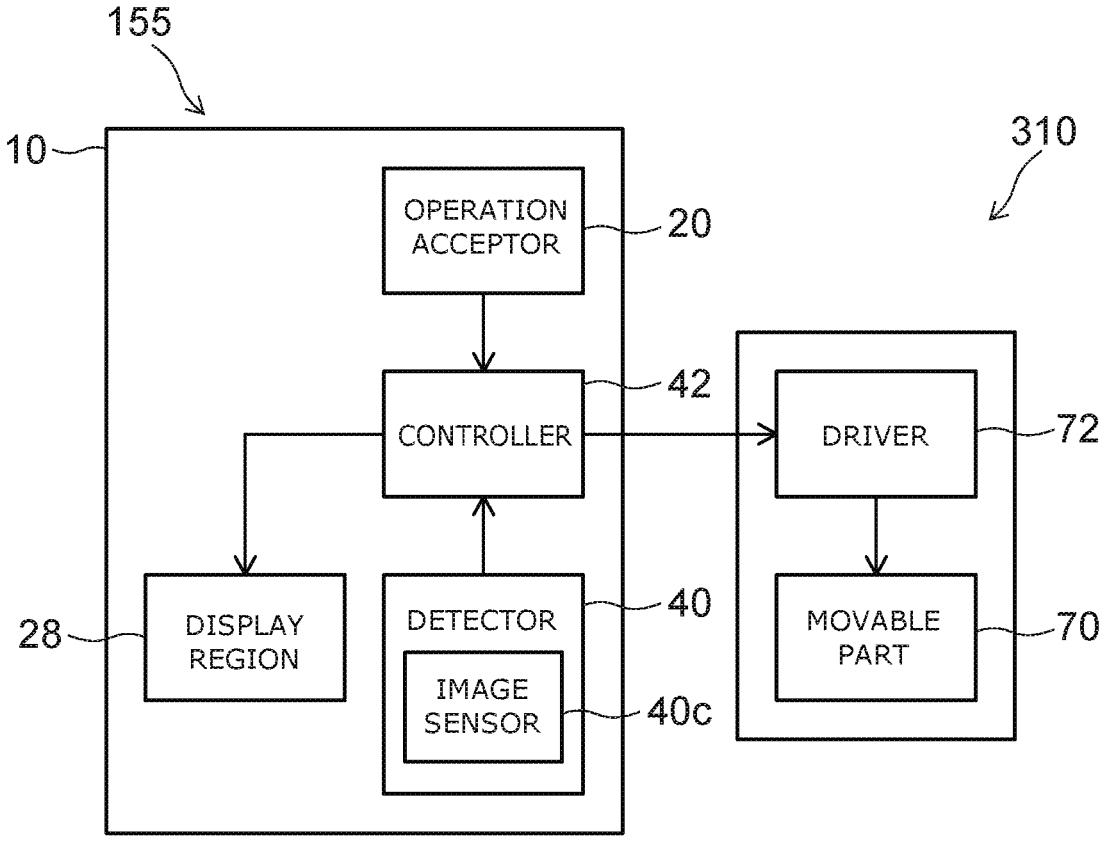
FIG. 7 is a block diagram illustrating a control device and electric furniture according to a fifth embodiment.

FIG. 7 is a block diagram illustrating the control device and the electric furniture according to the fifth embodiment.

As shown in FIG. 7, the control device 155 includes the operation part 10, the operation acceptor 20, the detector 40, and the display region 28. In the control device 155, an image sensor 40*c* is used as the detector 40.

For example, the distance between the operation part 10 and an object is detected by the detector 40 (the image sensor 40*c*). The display region 28 modifies the display based on the detection result of the distance. For example, the modification of the display is performed by the controller 42.

For example, the image sensor 40*c* detects the face of a human as the object. For example, the image sensor 40*c* extracts the face of the human from inside the captured image by using pattern matching, etc., and measures the distance between the image sensor 40*c* (i.e., the operation part 10) and the extracted face.

For example, the display content of the display region 28 is displayed to be large when the face of the user, etc., approaches the display region 28. For example, the brightness (e.g., the luminous intensity, the luminance, etc.) of the display of the display region 28 may be modified when the face of the user, etc., approaches the display region 28.

By modifying the display of the display region 28 based on the detection result of the distance to the object, the display region 28 can be easier to view while suppressing an increase of the number of components, a higher cost, etc. The convenience can be improved further.

Any configuration that can detect the distance to the object is applicable to detect the distance to the object in the detector 40. For example, the distance to the object may detect using a distance sensor, etc. The object may be, for example, a hand (the hand of the operator), etc.

The data (static image data, video image data, or the like) that is obtained by the image sensor 40*c* may be transmitted to an external device. The condition of the hospitalized patient, the care recipient, or the like utilizing the electric furniture 310 can be monitored from a remote location. For example, the transmission to the external device of the data can be performed by any communicator such as an Internet line, etc.

The data that is obtained by the image sensor 40*c* may be stored in a memory device. For example, the state of bedsores of the hospitalized patient, the care recipient, or the like is recorded. The memory device may be provided in the electric furniture 310 or may be provided in any server that can communicate with the electric furniture 310.

In the embodiment, the switching between the non-accepting state and the accepting state may be performed based on the detection result of the image sensor 40*c*.

Sixth Embodiment

In a sixth embodiment, the brightness of an illuminator provided separately from the control device is modified. The switching between the non-accepting state and the accepting state described in the first embodiment may be performed in the sixth embodiment.

Figure 8:
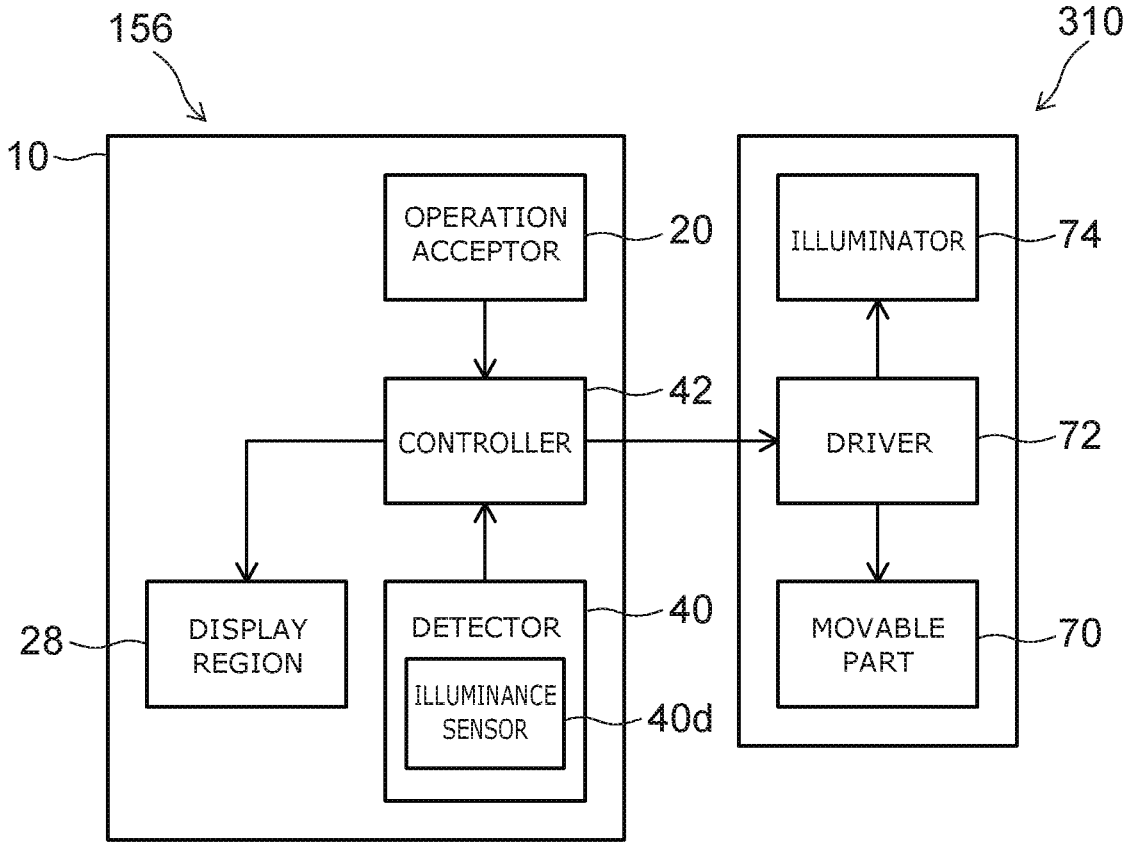
FIG. 8 is a block diagram illustrating a control device and electric furniture according to a sixth embodiment.

FIG. 8 is a block diagram illustrating the control device and the electric furniture according to the sixth embodiment.

An illuminator 74 is provided as shown in FIG. 8, In the example, the illuminator 74 is provided in the electric furniture 310. The illuminator 74 emits light into the space of the periphery of the electric furniture 310. For example, the illuminator 74 is a foot light illuminating the foot of the electric bed. In the example, the illuminator 74 is connected to the driver 72; and the control of the brightness of the illuminator 74 (including switching on and switching off) is performed by the driver 72. The illuminator 74 may be provided as a separate body from the electric furniture 310. In the control device 156, the detector 40 includes an illuminance sensor 40*d*.

For example, the detector 40 (the illuminance sensor 40*d*) detects the brightness of the periphery of the operation part 10. For example, when the brightness of the periphery of the operation part 10 is less than a threshold, the illuminator 74 is switched on; for example, in the case where the hospitalized patient, the care recipient, or the like gets up alone at night, etc., the feet vicinity of the hospitalized patient, the care recipient, or the like can be illuminated; and a fall of the hospitalized patient, the care recipient, or the like can be suppressed. For example, the illuminator 74 is switched off when the brightness of the periphery of the operation part 10 is not less than the threshold. For example, such an operation of switching on and switching off is performed by the controller 42, the driver 72, etc., based on the detection result of the detector 40.

In the embodiment, a signal based on the detection result by the detector 40 of the brightness of the periphery can be output externally. For example, the brightness of the illuminator 74 is controlled based on the signal output externally. It is possible to control the switching on, the switching off, etc., of the illuminator 74 which is the external device while suppressing an increase of the number of components, a higher cost, etc. The convenience can be improved further. For example, a fall of the hospitalized patient, the care recipient, or the like can be suppressed; and the safety can be improved further.

In the embodiment, the switching between the non-accepting state and the accepting state may be performed based on the detection result of the detector 40 (the illuminance sensor 40*d*).

Seventh Embodiment

In a seventh embodiment, the detector 40 includes a pulse wave sensor. The detector 40 can measure a pulse wave. The switching between the non-accepting state and the accepting state described in the first embodiment may be performed in the seventh embodiment.

Figure 9:
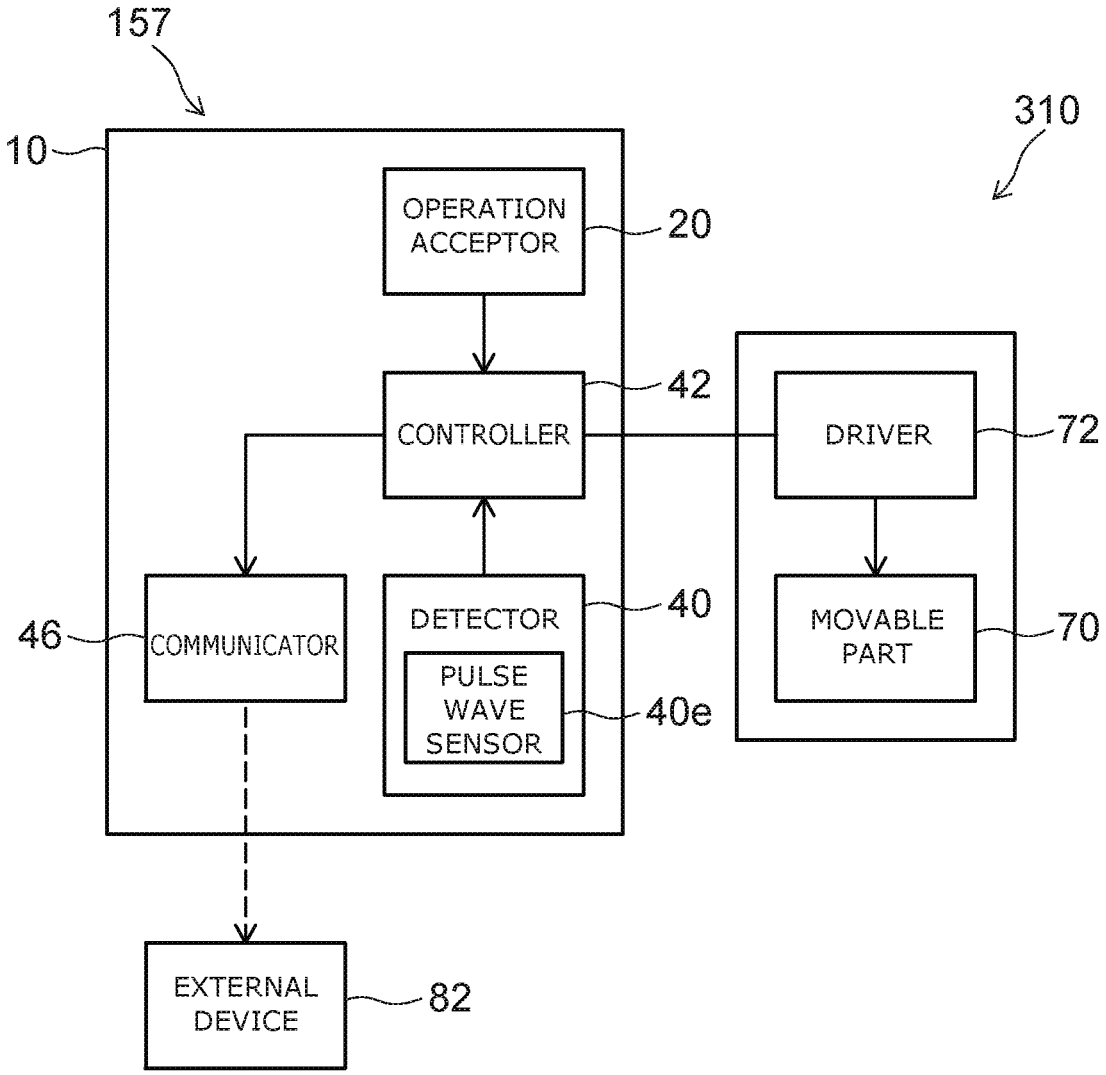
FIG. 9 is a block diagram illustrating a control device and electric furniture according to a seventh embodiment.

FIG. 9 is a block diagram illustrating the control device and the electric furniture according to the seventh embodiment.

As shown in FIG. 9, the control device 157 according to the embodiment includes a communicator 46 in addition to the operation part 10, the operation acceptor 20, and the detector 40. The detector 40 also includes a pulse wave sensor 40*e*. Otherwise, the configuration of the control device 157 can be similar to the configuration of the control device 150; and a description is therefore omitted.

The communicator 46 is connected to an external device 82 via a network, etc.; and communication with the external device 82 is possible. For example, the communication of the communicator 46 is controlled by the controller 42.

The pulse wave of the user or the like is measurable by the pulse wave sensor 40*e* of the detector 40. For example, the control device 157 includes a pulse wave measuring mode and a control operation mode of the electric furniture 310. These modes are switched. For example, the switching is performed by the operation of the operation acceptor 20. In the pulse wave measuring mode, the pulse wave of the user or the like holding the control device 157 (the operation part 10) is measured. In the control operation mode, the operation of the movable part 70 is controlled according to the operation of the operation acceptor 20 when in the operation accepting state.

The data of the pulse wave acquired by the pulse wave sensor 40*e* is supplied to the external device 82 via the communicator 46. The external device 82 is, for example, a server storing a database of electronic medical charts.

Because the detector 40 can measure the pulse wave, for example, the convenience can be improved while suppressing an increase of the number of components, a higher cost, etc. By supplying the data acquired by the communicator 46 to the external device 82, for example, the data is stored automatically in the electronic medical chart. The convenience is improved further.

The external device 82 may be a printer; and the acquired data can be printed on a paper medium, etc. The external device is arbitrary.

In the embodiment, the switching between the non-accepting state and the accepting state may be performed based on the detection result of the detector 40 (the pulse wave sensor 40*e*).

Eighth Embodiment

In an eighth embodiment, the detector 40 includes a temperature sensor. The detector 40 can measure a temperature. The switching between the non-accepting state and the accepting state described in the first embodiment may be performed in the eighth embodiment.

Figure 10:
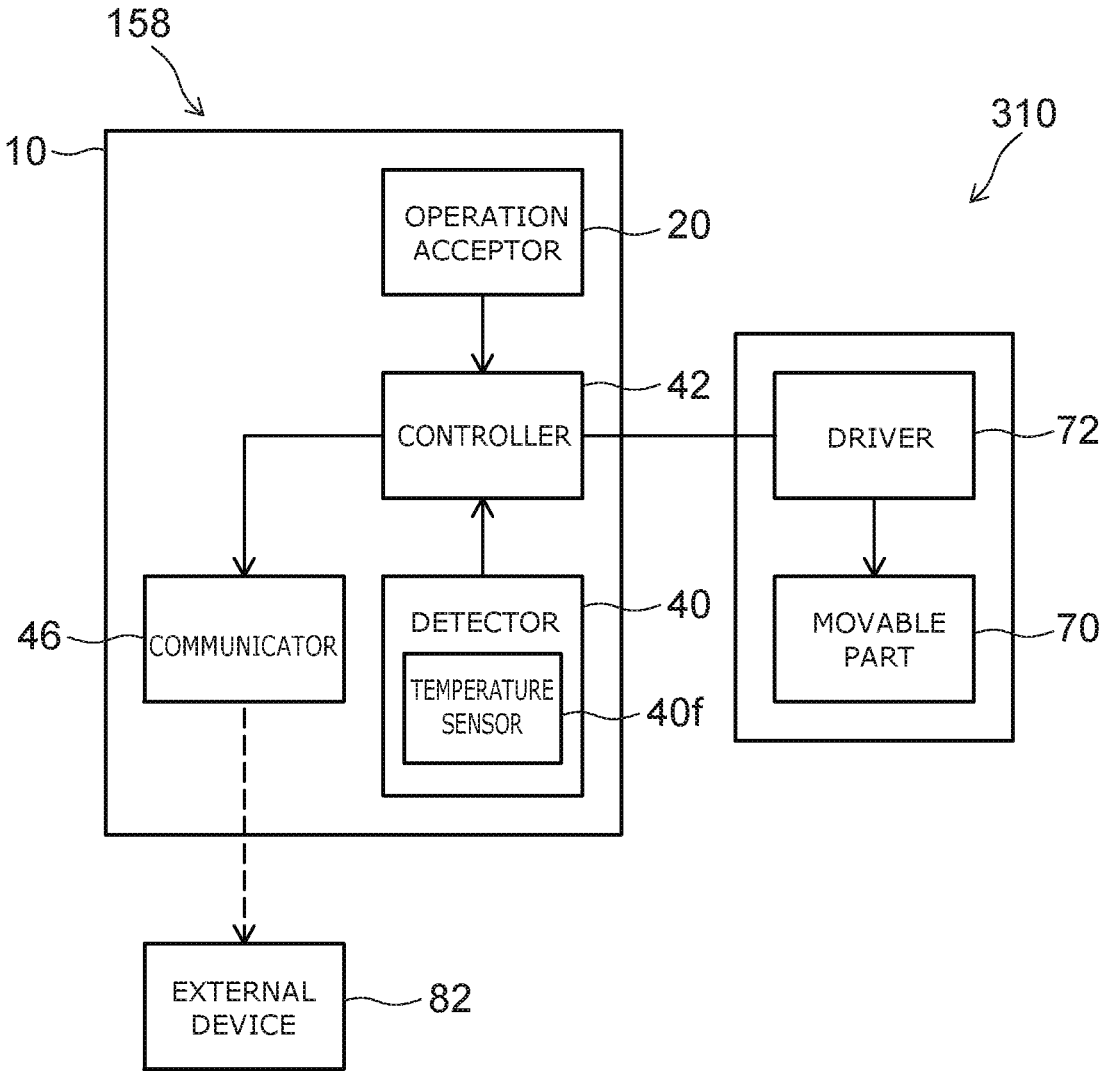
FIG. 10 is a block diagram illustrating a control device and electric furniture according to an eighth embodiment.

FIG. 10 is a block diagram illustrating the control device and the electric furniture according to the eighth embodiment.

As shown in FIG. 10, the control device 158 according to the embodiment includes the communicator 46 in addition to the operation part 10, the operation acceptor 20, and the detector 40. The detector 40 also includes a temperature sensor 40*f*. Otherwise, the configuration of the control device 158 can be similar to the configuration of the control device 150; and a description is therefore omitted.

The body temperature of the user or the like is measurable by the temperature sensor 40*f* of the detector 40. For example, the control device 158 includes a temperature measuring mode (a body temperature measuring mode) and the control operation mode of the electric furniture 310. These modes are switched. For example, the switching is performed by the operation of the operation acceptor 20. For example, the measurement of the body temperature of the operator holding the operation part 10 is performed using the temperature sensor 40*f* in the body temperature measuring mode. The measured data is supplied to the external device 82 via the communicator 46. In the control operation mode, the operation of the movable part 70 is controlled according to the operation of the operation acceptor 20 when in the operation accepting state.

Because the detector 40 can measure the body temperature, the convenience can be improved further while suppressing an increase of the number of components, a higher cost, etc.

The detector 40 may be capable of measuring the room temperature. For example, a notification is performed to the external device 82 via the communicator 46 when the room temperature based on the measurement result by the temperature sensor 40*f* of the room temperature is not less than a threshold. In such a case, for example, the external device 82 is a terminal provided in a nurse center, a terminal provided in a business location of an in-home care service, etc.

By performing the notification in the case where the room temperature detected by the detector 40 is not less than the threshold, etc., for example, the onset of heatstroke of the hospitalized patient, the care recipient, or the like can be suppressed while suppressing an increase of the number of components, a higher cost, etc. The convenience can be improved further.

For example, the communicator 46 may be replaced with the outputter 44. In such a case, the danger of heatstroke, etc., may be notified to the hospitalized patient, the care recipient, or the like himself or herself by performing the notification of a light, a voice, etc., from the outputter 44.

In the embodiment, the switching between the non-accepting state and the accepting state may be performed based on the detection result of the detector 40 (the temperature sensor 40*f*).

Figure 11:
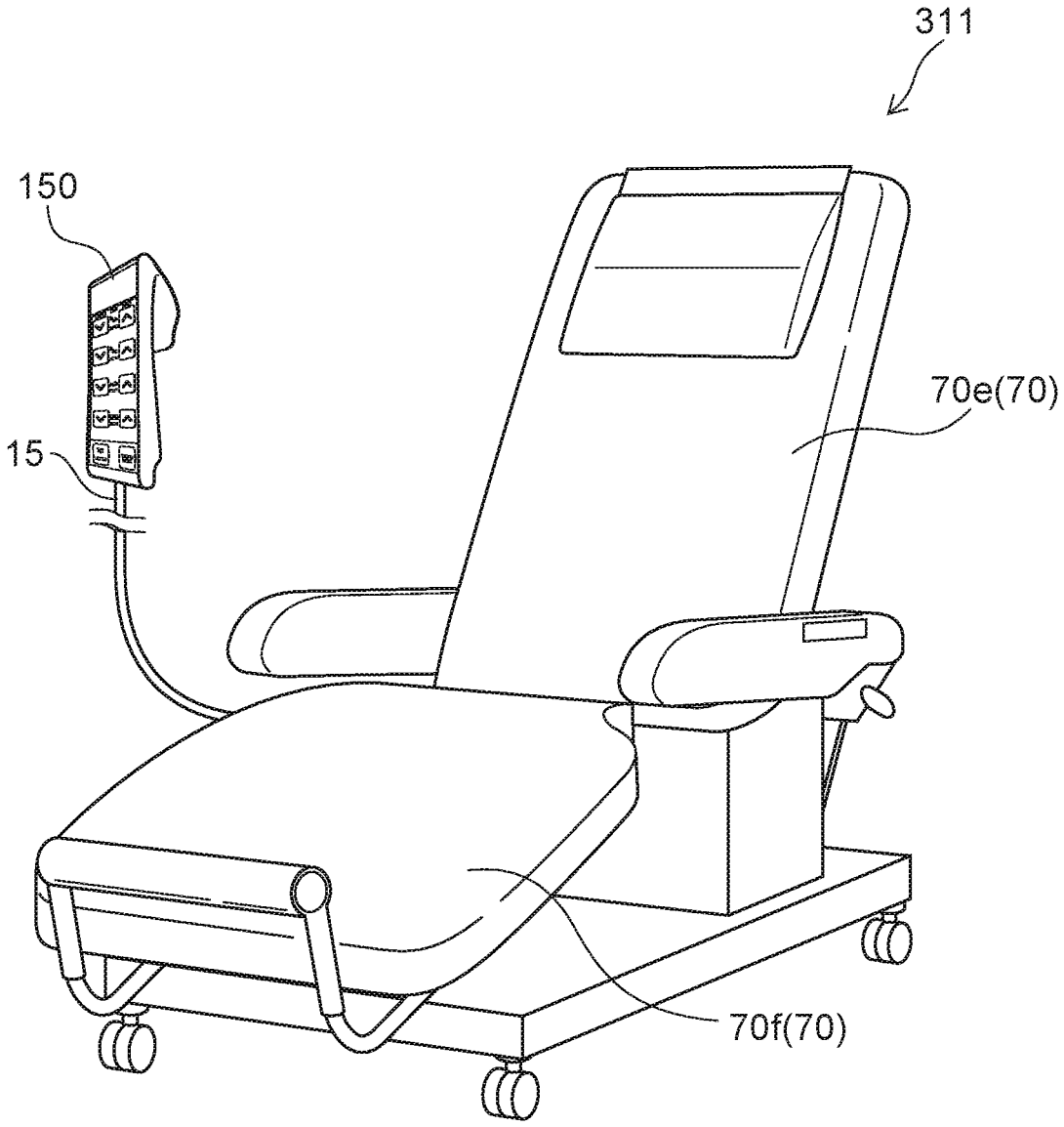
FIG. 11 is a schematic perspective view illustrating another electric furniture including the control device according to the embodiment.

FIG. 11 is a schematic perspective view illustrating another electric furniture including the control device according to the embodiment.

As shown in FIG. 11, the electric furniture 311 is an electric reclining chair. The electric furniture 311 includes the movable part 70. The movable part 70 includes, for example, a backrest part 70*e* and a seat surface part 70*f*. These movable parts 70 are controlled by the control device 150 (or 151 to 157, etc.) according to the embodiments. In the electric furniture 311 as well, electric furniture can be provided in which the operationability can be improved.

Generally, for the safety of electric furniture (an electric bed, an electric reclining chair, a stretcher, or the like) supporting a body such as an electric bed, an electric reclining chair, etc., a double-action operation may be provided in the control device. The control device and the electric furniture are set to an operatable state by once operating a switch, etc.; and the desired operation of the height adjustment, the angle adjustment, or the like is performed from the second operation. Thereby, an unintended operation can be suppressed; and the safety can be improved. However, for example, there is a possibility that a senior citizen may not easily understand the double-action operation and may misunderstand that the double-action operation is a malfunction. According to the embodiment, because the non-accepting state transitions to the accepting state based on the detection result of the detector 40, the operationability can be improved; and good safety also is obtained.

The embodiments may include the following configurations (proposals).

Configuration 1

A control device, comprising:

an operation part including an operation acceptor capable of accepting a control operation of a movable part of electric furniture; and a detector provided in the operation part, the control device transitioning from a non-accepting state to an accepting state based on a detection result of the detector, the movable part not being controlled in the non-accepting state even when the operation acceptor receives an input, the movable part being controlled in the accepting state according to the control operation accepted by the operation acceptor.

Configuration 2

The control device according to Configuration 1, wherein the detector includes at least one of an acceleration sensor, a touch sensor, a temperature sensor, an illuminance sensor, a pulse wave sensor, an atmospheric pressure sensor, a vibration sensor, a pressure sensor, an image sensor, or a distance sensor.

Configuration 3

The control device according to Configuration 1, wherein the detector includes a pulse wave sensor, and the detector is capable of measuring a pulse wave.

Configuration 4

The control device according to Configuration 1, wherein the detector includes a temperature sensor, and the detector is capable of measuring at least one of a body temperature of an operator of the operation part or a temperature of a periphery of the operation part.

Configuration 5

The control device according to any one of Configurations 1 to 4, further comprising an outputter outputting a notification signal when the detector detects a fall of the operation part.

Configuration 6

The control device according to any one of Configurations 1 to 5, wherein the detector transitions from the non-accepting state to the accepting state when the detector detects that the control device is being held, and in the accepting state, the movable part is controlled according to the control operation accepted by the operation acceptor.

Configuration 7

The control device according to any one of Configurations 1 to 5, wherein the control device is set to the non-accepting state when the detector detects that the operation acceptor is placed facing downward.

Configuration 8

The control device according to any one of Configurations 1 to 7, further comprising a light emitter provided in the operation part, a brightness of the light emitter being changeable according to a detection result by the detector of an orientation of the operation part.

Configuration 9

The control device according to any one of Configurations 1 to 7, wherein a function of the operation acceptor is modifiable according to a detection result by the detector of an orientation of the operation part.

Configuration 10

The control device according to any one of Configurations 1 to 7, wherein a movement of the movable part corresponding to the control operation of the operation acceptor is changeable according to a detection result of the detector.

Configuration 11

The control device according to any one of Configurations 1 to 7, further comprising a display region where a display is modified according to a detection result by the detector of a distance to an object.

Configuration 12

The control device according to any one of Configurations 1 to 7, wherein a detection result by the detector of a brightness of a periphery is outputtable externally.

Configuration 13

The control device according to any one of Configurations 1 to 12, wherein the electric furniture is a bed, the movable part includes a section of the bed, and in the accepting state, at least one operation of raising/lowering or back-raising is performed.

Configuration 14

Electric furniture, comprising:

the control device according to any one of Configurations 1 to 13; and the movable part.

Configuration 15

Electric furniture, comprising:

a movable part; and a controller, the controller including an operation part including an operation acceptor capable of accepting a control operation of the movable part, and a detector provided in the operation part, a non-accepting state transitioning to an accepting state based on a detection result of the detector, the movable part not being controlled in the non-accepting state even when the operation acceptor receives an input, the movable part being controlled in the accepting state according to the control operation accepted by the operation acceptor.

According to the embodiments, a control device and electric furniture can be provided in which the operationability can be improved.

Hereinabove, embodiments of the invention are described with reference to specific examples. However, the invention is not limited to these specific examples. For example, one skilled in the art may similarly practice the invention by appropriately selecting specific configurations of components included in the control device such as the operation part, the operation acceptor, the detector, the controller, etc., from known art; and such practice is within the scope of the invention to the extent that similar effects can be obtained.

Any two or more components of the specific examples can be combined within the extent of technical feasibility and are within the scope of the invention to the extent that the spirit of the invention is included.

Also, all control devices and electric furniture practicable by an appropriate design modification by one skilled in the art based on the control devices and the electric furniture described above as embodiments of the invention also are within the scope of the invention to the extent that the spirit of the invention is included.

Further, various modifications and alterations within the spirit of the invention will be readily apparent to those skilled in the art; and all such modifications and alterations should be seen as being within the scope of the invention.

REFERENCE NUMERAL LIST

10 operation part
10*a* first surface
15 cable
20 operation acceptor
21*a*, 21*b*, 22*a*, 22*b*, 23*a*, 23*b*, 24*a*, 24*b* button
27 function displayer
28 display region
40 detector
40*a* acceleration sensor
40*c* image sensor
40*d* illuminance sensor
40*e* pulse wave sensor
40*f* temperature sensor
42 controller
44 outputter
45 light emitter
46 communicator
70 movable part
70*a* back section
70*b* upper leg section
70*c* lower leg section
70*d* height adjuster
70*e* backrest part

70*f* seat surface part
72 driver
74 illuminator
80 notifier
82 external device
150 to 158 control devices
310, 311 electric furniture

The invention claimed is:

1. A control device, comprising:
an operation part including an operation acceptor capable of accepting a control operation of a movable part of electric furniture;
an acceleration sensor provided in the operation part;
a light emitter provided in the operation part;
an outputter outputting a notification signal when the acceleration sensor detects a fall of the operation part,
the control device transitioning from a non-accepting state to an accepting state based on a detection result of the acceleration sensor, the movable part not being controlled in the non-accepting state even when the operation acceptor receives an input, the movable part being controlled in the accepting state according to the control operation accepted by the operation acceptor,
a brightness of the light emitter being changeable according to the non-accepting state and the accepting state, and
the outputter outputs light or voice sound as the notification signal.

2. The control device according to claim 1, wherein
the control device transitions from the non-accepting state to the accepting state when the acceleration sensor detects that the control device is being held, and
in the accepting state, the movable part is controlled according to the control operation accepted by the operation acceptor.

3. The control device according to claim 1, wherein the control device is set to the non-accepting state when the acceleration sensor detects that the operation acceptor is placed facing downward.

4. The control device according to claim 1, wherein
the brightness of the light emitter is changeable according to a detection result by the acceleration sensor of an orientation of the operation part.

5. The control device according to claim 1, wherein a function of the operation acceptor is modifiable according to a detection result by the acceleration sensor of an orientation of the operation part.

6. The control device according to claim 1, wherein a movement of the movable part corresponding to the control operation of the operation acceptor is changeable according to a detection result of the acceleration sensor.

7. The control device according to claim 1, wherein
the electric furniture is a bed,
the movable part includes a section of the bed, and
in the accepting state, at least one operation of raising/lowering or back-raising is performed.

8. Electric furniture, comprising:
the control device according to claim 1; and
the movable part.

9. Electric furniture, comprising:
a movable part; and
a controller,
the controller including:
an operation part including an operation acceptor capable of accepting a control operation of the movable part;
an acceleration sensor provided in the operation part; and
a light emitter provided in the operation part; and
an outputter outputting a notification signal when the acceleration sensor detects a fall of the operation part,
a non-accepting state of the controller transitioning to an accepting state based on a detection result of the acceleration sensor, the movable part not being controlled in the non-accepting state even when the operation acceptor receives an input, the movable part being controlled in the accepting state according to the control operation accepted by the operation acceptor,
a brightness of the light emitter being changeable according to the non-accepting state and the accepting state, and
the outputter outputs light or voice sound as the notification signal.

10. The control device according to claim 1, further comprising:
a pulse wave sensor; and
a communicator connected to an external device via a network, wherein
data from the pulse wave sensor is supplied to the external device via the communicator.

11. The control device according to claim 1, further comprising:
a temperature sensor; and
a communicator connected to an external device via a network, wherein
data from the temperature sensor is supplied to the external device via the communicator.

* * * * *